US005647947A

United States Patent [19]

Yasui et al.

[11] Patent Number: 5,647,947

[45] Date of Patent: Jul. 15, 1997

[54] BELT SPEED CONTROLLER IN SINGLE FACER

[75] Inventors: Toshihiko Yasui, Owariasahi; Kazuhiro Hatasa, Ena-gun, both of Japan

[73] Assignee: Kabushiki Kaisha Isowa, Aichi, Japan

[21] Appl. No.: 435,216

[22] Filed: May 5, 1995

[30] Foreign Application Priority Data

May 16, 1994 [JP] Japan ..... 6-126765

[51] Int. Cl.[6] ..... B31F 1/20

[52] U.S. Cl. ..... 156/361; 156/472

[58] Field of Search ..... 156/361, 470, 156/471, 472, 473

[56] References Cited

U.S. PATENT DOCUMENTS

| | | | |
|---|---|---|---|
| 3,127,292 | 3/1964 | Early | 156/361 |
| 3,516,889 | 6/1970 | Boynton et al. | 156/361 |
| 4,038,122 | 7/1977 | DeLigt | 156/361 |
| 4,188,253 | 2/1980 | Swartz | 156/361 |
| 5,169,484 | 12/1992 | Isowa et al. | 156/472 |
| 5,344,520 | 9/1994 | Seki et al. | 156/472 |

*Primary Examiner*—James P. Mackey
*Attorney, Agent, or Firm*—Koda and Androlia

[57] ABSTRACT

Disclosed is a belt speed controller in a single facer consisting of an upper fluted roll, a lower fluted roll, a gluing mechanism, and an application mechanism having an endless belt extended over a plurality of rolls so as to be able to run freely thereby; in which a liner is pressed against the glued crests of corrugation of a corrugating medium to be pasted therewith to form a single-faced corrugated board, characterized in that the speed controller consists of a braking apparatus for braking the roll, of the plurality of rolls over which the belt is extended, locating on the upstream side, with respect to the belt running direction, of the press contact zone where the belt is brought into press contact with the liner, and a control means which actuates the braking means to brake the endless belt via the roll. Since the endless belt is decelerated by the speed controller synchronously with or immediately before deceleration of the upper and lower fluted rolls, the belt can constantly be maintained slackless to achieve secured bonding between the corrugating medium and the liner.

3 Claims, 7 Drawing Sheets

BELT SPEED CONTROLLER IN SINGLE FACER

BACKGROUND OF THE INVENTION

1. Field of the Invention

This invention relates to a belt speed controller in a single facer for producing a single-faced corrugated board by nipping a corrugating medium and a liner between a lower fluted roll and an endless belt extended over a plurality of rolls so as to paste them together, in which a braking force is applied to the endless belt when the lower fluted roll is decelerated to prevent defective bonding between the corrugating medium and the liner to be caused by the difference in the speed of the lower fluted roll and that of the endless belt.

2. Description of the Related Art

In a system for forming a single-faced corrugated board (so-called single facer), an upper fluted roll and a lower fluted roll each having wavy flutes formed on the circumference are rotatably supported between frames in a vertical relationship in such a way that they may engage with each other by their flutes, and a press roll is designed to be brought into press contact with the lower fluted roll via a corrugating medium and a liner which are the webs of the single-faced corrugated board. Namely, the corrugating medium, which is fed between the upper fluted roll and the lower fluted roll, is allowed to have a predetermined corrugation (flutes) when it passes between these rolls. A starchy glue is applied to the crests of corrugation thus formed by a gluing roll provided in a gluing mechanism. Meanwhile, the liner being fed from the side opposite to the corrugating medium via the press roll is pressed against the glued crests of the corrugating medium between the press roll and the lower fluted roll to be pasted together and form a single-faced corrugated board.

The press roll employed in the conventional single facer is of a large-diameter metallic roll which is normally urged toward the lower fluted roll so as to apply a predetermined nip pressure to the corrugating medium and liner passing between these rolls. Since flutes consisting of continuous alternative repetition of crests and troughs are formed at a predetermined pitch on the circumference of the lower fluted roll, the rotation center of the lower fluted roll and that of the press roll shift slightly as the point of press contact therebetween shifts from the trough to the crest or vice versa. Thus, as the result that the rotation centers of these rolls make cyclic reciprocating motions to be closer to or farther from each other as they rotate, great vibration and big noise are generated during formation of the single-faced corrugated board, causing the working environment in the plant to be worsened considerably. Besides, since both the press roll and the lower fluted roll are made of rigid metallic materials, an impact is periodically applied to the press roll (so-called the hammer phenomenon) every time the crests of the lower fluted roll are abutted against the press roll. Accordingly, linear press marks corresponding to the pitch of the crests of the lower fluted roll are formed horizontally on the surface of the liner in the thus formed single-faced corrugated board, disadvantageously.

As a countermeasure for the problems described above, it is proposed to use an endless belt in place of the metallic press roll so as to nip the corrugating medium and the liner in cooperation with the lower fluted roll. More specifically, the endless belt, which is extended over a plurality of rolls to run freely, is disposed adjacent to the lower fluted roll, and the corrugating medium and the liner passing between the lower fluted roll and the endless belt are adapted to be nipped therebetween and pasted together by bringing the endless belt closer to the outer surface of the lower fluted roll. Thus, the use of the endless belt can prevent generation of great vibration and big noise and also formation of press marks on the single-faced corrugated board.

In a corrugating machine provided with such single facer, a corrugating medium and a liner to be fed to the single facer is spliced with the webs currently used, respectively, in accordance with an order change which occurs during operation of the machine, and the running speed of the single facet is decelerated to a predetermined level for such purpose. In such case, because of the inertia of the endless belt which is greater than that of the lower fluted roll, the endless belt cannot be decelerated correspondingly at the initial stage of decelerating the upper and lower fluted rolls to cause a difference to be generated between the speed of the endless belt and those of the fluted rolls over the zone where the corrugating medium and liner are nipped between the endless belt and the lower fluted roll. Namely, if a difference is generated between the speed of the lower fluted roll which is in contact with the corrugating medium and the endless belt which is in contact with the liner, the corrugating medium and the liner slip from each other with respect to the feeding direction.

This invention is proposed in view of the problems inherent in the prior art and to solve them in a suitable manner, and it is an objective of the invention to provide a belt speed controller in a single facer which can prevent generation of difference between the speed of the lower fluted roll and that of the endless belt during deceleration of the lower fluted roll and can constantly achieve excellent bonding between the corrugating medium and the liner.

SUMMARY OF THE INVENTION

In order to solve the above problems and attain the intended object of the invention successfully, the present invention provides a belt speed controller, in a single facer consisting of an upper fluted roll having flutes formed on the circumference thereof; a lower fluted roll, also having on the circumference thereof flutes which are engaged with those of the upper fluted roll to form a predetermined corrugation on a corrugating medium passed between the upper fluted roll and the lower fluted roll; a gluing mechanism for gluing the crests of corrugation in the corrugating medium; and an application mechanism which is disposed adjacent to the lower fluted roll and equipped with an endless belt extended over a plurality of rolls so as to be able to run freely thereby; in which a liner is pressed against the glued crests of corrugation of the corrugating medium fed along the circumference of the lower fluted roll to be pasted with the corrugating medium and form a single-faced corrugated board; characterized in that the speed controller consists of a braking means for braking the roll, of the plurality of rolls over which the belt is extended, locating on the upstream side, with respect to the belt running direction, of the press contact zone where the belt is brought into press contact with the liner, and a control means which actuates the braking means to brake the endless belt via the roll.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiment taken in conjunction with the accompanying drawings in which:

DETAILED DESCRIPTION OF THE PREFERRED EMBODIMENTS

The belt speed controller in a single facer according to this invention will now be described by way of preferred embodiments referring to the attached drawings. Before making description of the constitution of the belt speed controller, the general constitution of the single facer in which the controller is to be employed will be described.

(General constitution of single facer)

Figure 1:
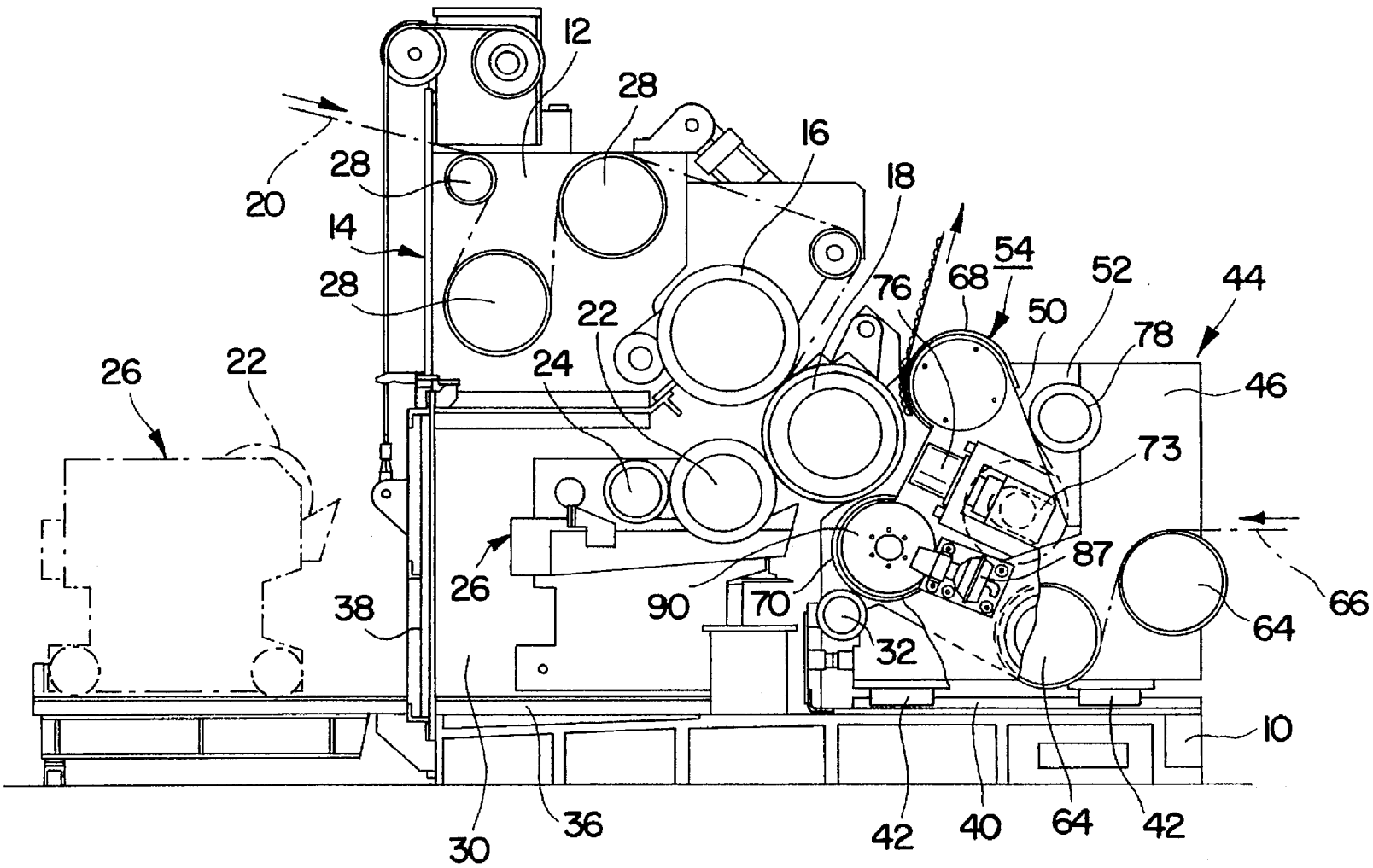
FIG. 1 shows schematically a constitution of a single facer employing a belt speed controller according to one embodiment of this invention.

As shown in FIG. 1, a main body 14 of the single facer is disposed on a base 10 installed on the floor of a plant. The single facer consists of a pair of opposing fixed frames 12 (only one frame is shown) arranged to be spaced from each other (one on the drive side and the other on the operational side) on the line orthogonal to the direction of feeding a corrugating medium 20, and an upper fluted roll 16 having flutes formed on the circumference thereof and a lower fluted roll 18 also having flutes formed on the circumference thereof, which are rotatably supported between these frames 12. The rotary shaft of the upper fluted roll 16 locates diagonally above that of the lower fluted roll 18, and the flutes of the upper fluted roll 16 are designed to be engageable with those of the lower fluted roll 18 via the corrugating medium 20. Meanwhile, a gluing mechanism 26 consisting of a gluing roll 22 and a doctor roll 24 is disposed immediately below the upper fluted roll 16 and diagonally below the lower fluted roll 18. The corrugating medium 20 is fed from a web feeding source (not shown) which is assumed to locate on the left side in FIG. 1, via a plurality of guide rolls 28, to the engagement zone defined between the upper fluted roll 16 and the lower fluted roll 18 to be provided with a predetermined corrugation by passing the engagement zone. The thus corrugated corrugating medium 20 is glued at the crests by the gluing mechanism 26 and then diverted upward along the circumference of the lower fluted roll 18.

Figure 3:
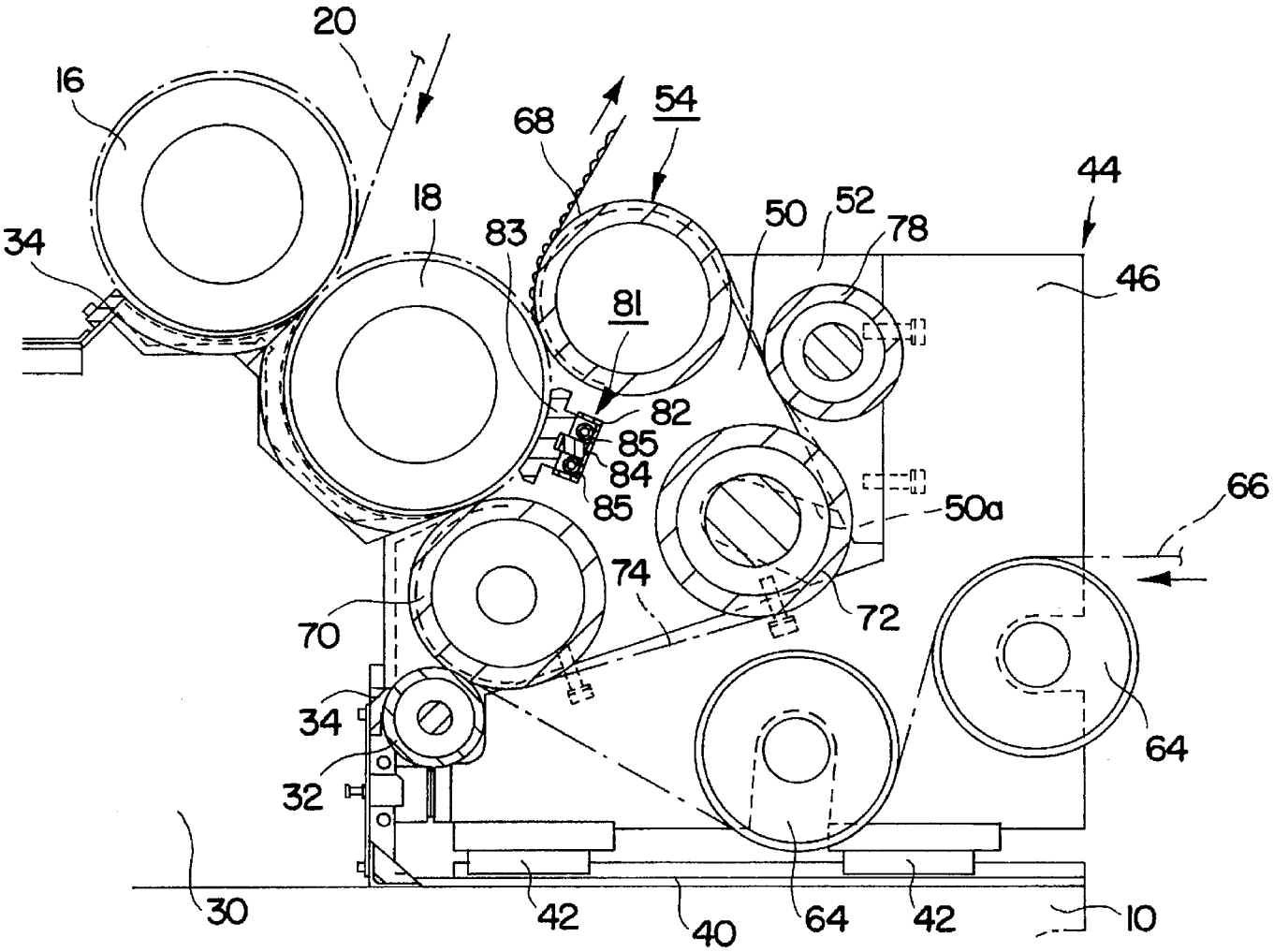
FIG. 3 shows schematically a vertical cross-sectional view of the major section of the single facer according to the embodiment of the invention.

A pressure chamber 30, in which the gluing mechanism 26 is to be housed, is defined immediately below the upper fluted roll 16 and diagonally below the lower fluted roll 18. The pressure chamber 30 is open toward the upper fluted roll 16 and the lower fluted roll 18. As shown in FIG. 3, sealing members 34 are interposed between the opening of the pressure chamber 30 and the upper fluted roll 16 and between the opening and a seal roll 32 disposed immediately below the lower fluted roll 18 along the axes thereof, respectively, so that the pressure chamber 30 may be maintained substantially airtight. A compressed air is fed from a source (not shown) to the pressure chamber 30 so as to maintain the inside of the chamber 30 to be slightly higher than the atmospheric pressure (e.g. by 0.15 atm). In this case, the outer circumference of the lower fluted roll 18 facing the pressure chamber 30 is assuming the atmospheric pressure by virtue of the circumferential grooves (not shown) defined at predetermined intervals in the axial direction. Accordingly, the corrugating medium 20 corrugated by passing between the upper fluted roll 16 and the lower fluted roll 18 can be fed stably as pressed against the roll surface due to the difference between the pressure in the pressure chamber 30 and that on the circumference of the lower fluted roll 18. Incidentally, as the means for stably transferring the corrugating medium 20, a mode for retaining the corrugating medium 20 on the surface of the lower fluted roll 18 by a suction force to be applied from the roll 18 may suitably be employed.

The gluing mechanism 26 is disposed to be slidable along rails 36 laid on the bottom (base 10) of the pressure chamber 30, so that the gluing mechanism 26 can be carried out from the pressure chamber 30 along the rails 36 by opening a door 38 disposed on the left side of the pressure chamber 30 shown in FIG. 1.

Figure 4:
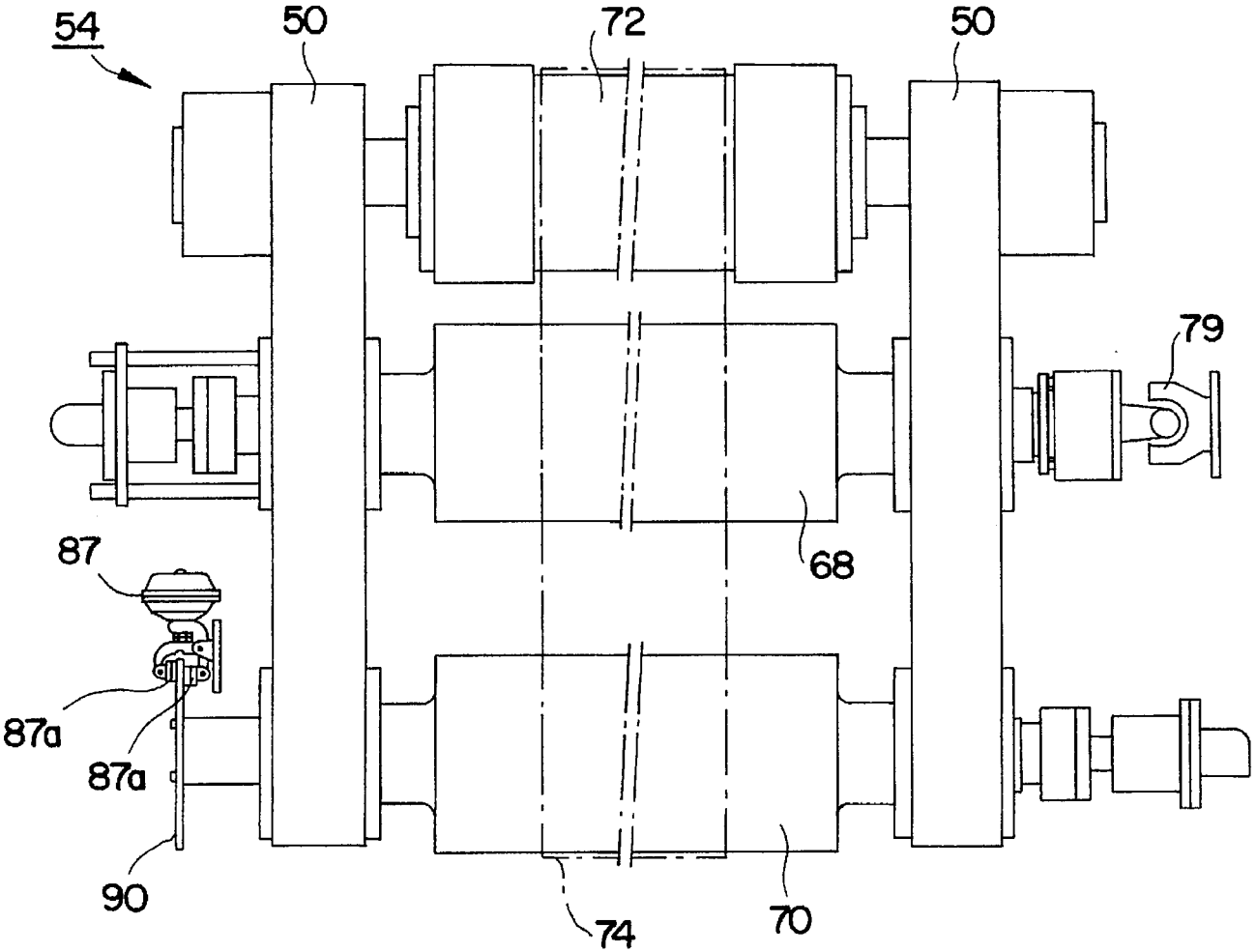
FIG. 4 shows an expanded side view of three rolls in the primary application mechanism according to the embodiment of the invention.
Figure 5:
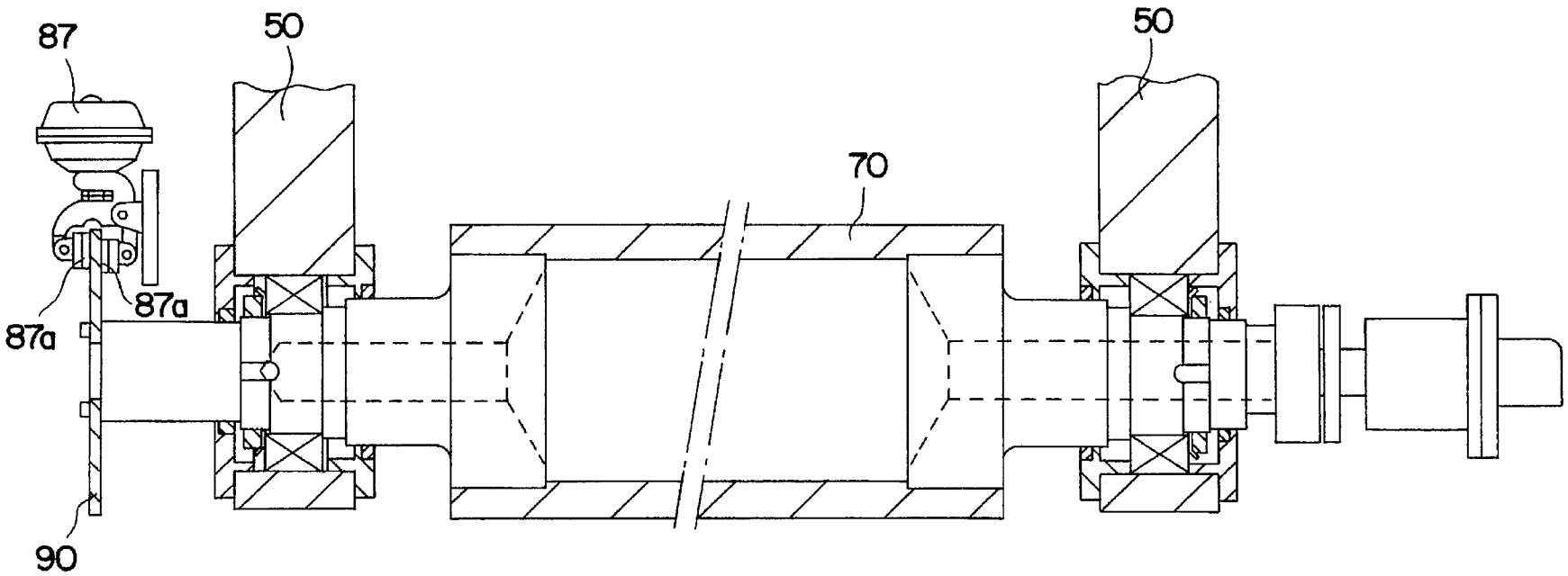
FIG. 5 shows a vertical cross-sectional side view of the major section of a braking means disposed to a preheating roll.

A pair of guide rails 40 (only one guide rail is shown) spaced from each other on the drive side and the operational side are laid on the base 10 at the portion extending rightward (at the position closer to the lower fluted roll 18) than the location of the main body 14, as shown in FIG. 1, and a movable body 44 is disposed on these guide rails 40 to be slidable via corresponding sliders 42. The movable body 44 can be moved along the guide rails 40 to be closer to or farther from the main body 14 by operating a hydraulic cylinder (not shown) provided on the base 10 in the positive or negative direction. The movable body 44 consists of a pair of movable frames 46 disposed separately on the drive side and operational side and opposing to each other, a pair of split frames 50 and a pair of auxiliary frames 52, which are fixed by a plurality of bolts 48 to the movable frames 46, respectively. A primary application mechanism 54 is disposed between the split frames 50 opposing to each other (see FIG. 4). A couple of roll-like preheaters 64 are disposed between the movable frames 46, as shown in FIG. 3. The liner 66 fed from a web feeding source (not shown) assumed to locate on the right side of FIG. 1 is fed via the preheaters 64 to the lower fluted roll 18 to be pasted with the corrugating medium 20 at the glued crests of corrugation and fed upward.

The application mechanism 54 for pasting the corrugating medium 20 with the liner 66 in cooperation with the lower fluted roll 18 is disposed between the split frames 50. Namely, a preheating roll 70 and a drive roll 68 are supported to oppose to the lower fluted roll 18 between the split frames 50 the former being disposed on the upstream side and the latter being disposed on the downstream side with respect to the direction of feeding the corrugating medium. Further, a tension roll 72 is also rotatably supported between the split frames 50 on the side farther from the lower fluted roll 18, and an endless belt 74 is extended over these three rolls 68,70,72 all supported between the split frames 50. The portion of the endless belt 74 running between the drive roll 68 and the preheating roll 70 is designed to be brought closer to the circumference of the lower fluted roll 18 to nip the corrugating medium 20 being fed along the circumference of the lower fluted roll 18 and the liner 66 to be pasted therewith in cooperation with the lower fluted roll 18. The preheating roll 70 locating at a lower position between the seal roll 32 and the lower fluted roll 18 is abutted against these rolls 32, 18 via the endless belt 74. Thus, the opening of the pressure chamber 30 is blocked by the upper fluted roll 16, lower fluted roll 18, preheating roll 70 and the seal roll 32. Incidentally, a seamless resin belt is preferably used as the endless belt 74.

The drive roll 68 is connected to a drive source (not shown) of the single facer via a universal joint 79 (not shown) to be rotated thereby, so as to drive the endless belt 74 to run at a predetermined speed synchronously with the upper fluted roll 16 and the lower fluted roll 18. It should be noted here that, since the drive roll 68 and the drive source(not shown) are connected by the universal joint 79, the movable body 44 is allowed to be moved closer to or farther from the main body 14. Meanwhile, the preheating roll 70 is connected to a high-temperature steam source (not shown), which distributes a high-temperature steam into the roll so as to heat the roll surface to a predetermined temperature. The liner 66 is heated via the endless belt 74 extended over the preheating roll 70 so as to achieve secured bonding with the corrugating medium 20.

The tension of the endless belt 74 is designed to be adjustable such that it can press the corrugating medium 20 and the liner 66 to be pasted therewith, which are fed along the circumference of the lower fluted roll 18, with an optimum contact pressure. Namely, supporting members 73 disposed to both axial end portions of the tension roll 72 are slidably fitted in slots 50*a* defined in the respective split frames 50, so that the tension roll 72 may be movable with respect to the split frames 50 in the radial direction of the lower fluted roll 18. Meanwhile, a couple of hydraulic cylinders 76 are mounted on the outer sides of the split frames 50, with the piston rods thereof being connected to the corresponding supporting members 73 (see FIG. 2). Accordingly, the tension roll 72 can be moved closer to or farther from the endless belt 74 by operating the pair of hydraulic cylinders 76 synchronously in the positive or negative direction, and thus the tension to be applied to the belt 74 can be adjusted. Incidentally, in the hydraulic cylinder 76 in this embodiment, the tension roll 72 is designed to be positioned relative to the endless belt 74 at three points: a position where a required tension is designed to be applied to the endless belt 74 to securely achieve bonding of the corrugating medium 20 with the liner 66; a position where a very small tension is applied to the endless belt 74 extended over the three rolls 68,70,72 to be slackless; and a position where the endless belt 74 is slackened to be releasable from the rolls 68,70,72 in the axial direction. Since the outer peripheral size of each split frame 50 is designed to be smaller than the inner circumferential size of the endless belt 74, the endless belt 74 can be withdrawn from the three rolls 68,70,72 in the axial direction without detaching the split frame 50.

A secondary application mechanism 81 is disposed to oppose to the lower fluted roll 18 via the endless belt 74 abutted against the liner 66 fed along the circumference of the lower fluted roll 18. The secondary application mechanism 81 compensates for the insufficiency in the bonding between the corrugating medium 20 and the liner 66 achieved by the primary application mechanism 54. This secondary application mechanism 81 consists of a housing 82 having a U-shaped cross section and extending parallel to the lower fluted roll 18, and a pressing member 83 which is disposed in the housing 82 to be movable in the radial direction of the lower fluted roll 18, as shown in FIG. 3. This pressing member 83 is substantially as wide as the entire length of the lower fluted roll 18 and has a predetermined length in the circumferential direction of the roll 18. That surface of the pressing member 83 which opposes to the lower fluted roll 18 is arcuated after the circumference of the roll 18. A partition 84 is disposed in the housing 82, and elastically deformable tubes 85 are disposed between the inner bottom surface of the housing 82 and the bottom of the pressing member 83 in the upper space and the lower space defined by the partition 84 (on each side of the partition 84 in the circumferential direction of the lower fluted roll 18), respectively. The respective tubes 85 are extended over the entire width of the pressing member 83, and a predetermined amount of compressed air is fed from compressed air supply sources (not shown) to these tubes 85, respectively, to expand the tubes 85 and allow the pressing member 83 to be brought into press contact with the lower fluted roll 18. Incidentally, the pressing member 83 and the tubes 85 may be designed to be separated into a plurality of blocks and arranged in the axial direction of the lower fluted roll 18 or may be arranged in a plurality of rows in the circumferential direction of the roll 18. Meanwhile, referring to the material of the pressing member 83, one which is softer and has a smaller coefficient of friction than the endless belt 74 can suitably be used, because the member 83 is brought into slide contact with the rear surface of the endless belt 74.

A guide roll 78 is rotatably supported between the auxiliary frames 52 to be parallel with those three rolls 68,70,72 over which the endless belt 74 is extended. The guide roll 78 locates outer than the portion of the endless belt 74 running between the drive roll 68 and the tension roll 72. The guide roll 78 is not an essential constituent and can be omitted.

(Belt speed controller)

When splicing of the corrugating medium 20 and liner 66 is to be carried out in accordance with an order change which occurs during operation of the single facer, the speed of the upper and lower fluted rolls 16,18 must be decelerated to a predetermined level. Since the inertia of the endless belt 74 is too great to follow the decelerated speed of the lower fluted roll 18 in this stage, as described above, there is a liability that a certain difference is generated between the speed of the lower fluted roll 18 and that of the endless belt 74 in the bonding zone where the corrugating medium 20 is pasted with the liner 66 (the site where the endless belt 74 is brought into press contact with the liner 66 fed along the circumference of the lower fluted roll 18) to cause defective bonding between the corrugating medium 20 and the liner 66. Meanwhile, the drive roll 68 in the primary application mechanism 54 in the embodiment is designed to be driven to rotate by the drive source of the single facer, so that the drive roll 68 can be decelerated synchronously with the deceleration of the upper and lower fluted rolls 16,18. Accordingly, since the preheating roll 70 and the tension roll 72 are merely driven via the endless belt 74, the endless belt 74 is slackened over the bonding zone. Namely, the endless belt 74 is slackened over the bonding zone as the result that a braking force is applied to the endless belt 74 with the deceleration of the drive roll on the downstream side of the bonding zone, while the endless belt 74 is driven by the preheating roll 70 rotating at the speed before deceleration. The slackness of the endless belt 74 over the bonding zone causes insufficiency in the bonding pressure to be applied to the corrugating medium 20 and liner 66, leading to a phenomenon of web separation. As described above, when the upper and lower fluted rolls 16, 18 are decelerated, defective bonding between the corrugating medium 20 and the liner 66 is liable to be caused due to the difference between the speed of the lower fluted roll 18 and that of the endless belt 74, as well as, to the slackness of the belt 74.

Therefore, in the embodiment, a positive braking force is applied beforehand to the endless belt 74 via the preheating roll 70 locating on the upstream side of the bonding zone immediately before deceleration of the upper and lower fluted rolls 16,18 so as to allow the endless belt 74 to run following the speed of the lower fluted roll 18 and to maintain constantly the endless belt 74 slackless.

Figure 2:
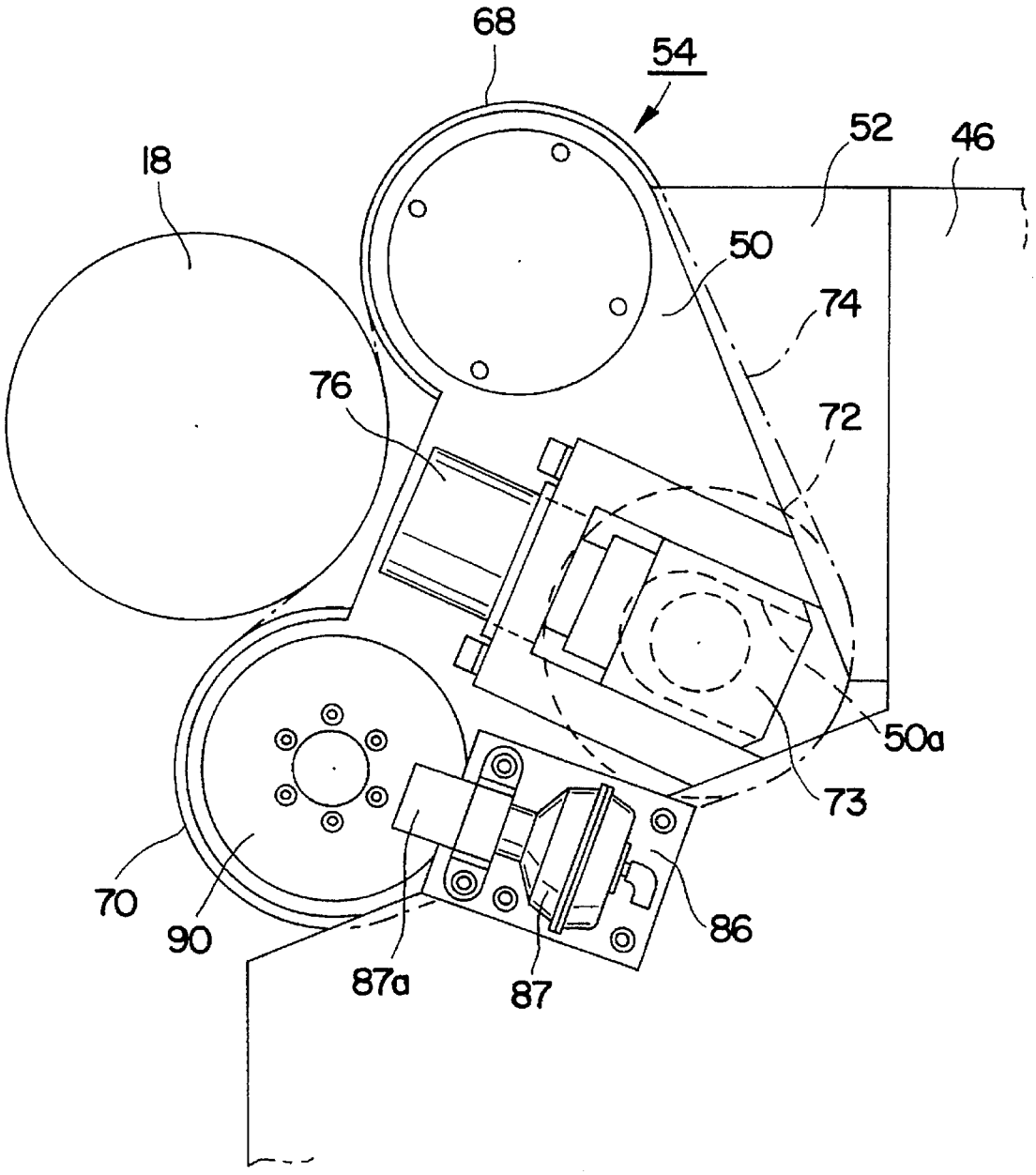
FIG. 2 shows schematically a side view of a primary application mechanism in the single facer according to the embodiment of the invention.
Figure 6:
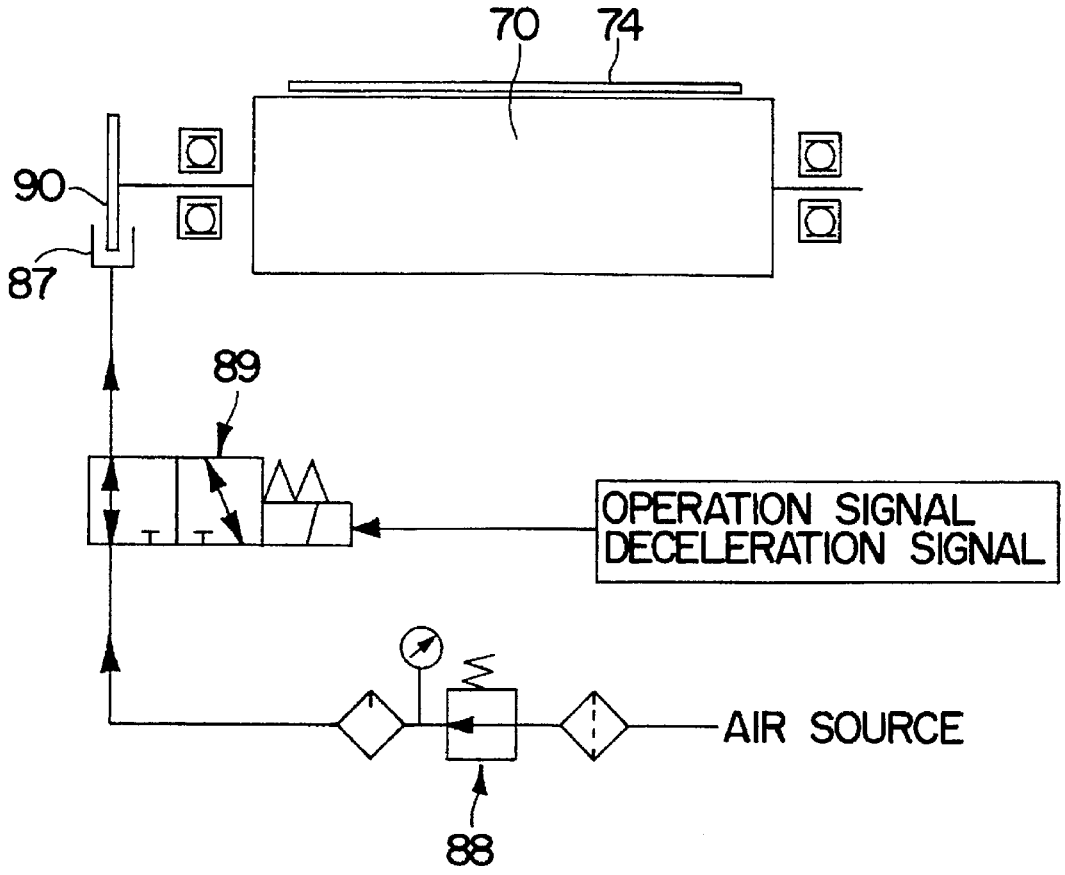
FIG. 6 is a control block diagram of the belt speed controller according to the embodiment of the invention.

Namely, a brake caliper 87 is disposed via a bracket 86 to the movable frame 46 locating on the operational side, as shown in FIG. 2, and air is designed to be supplied to the caliper 87 from an air source (not shown) via a pressure adjuster 88 provided with a pressure gauge and a solenoid switch valve 89 (see FIG. 6). Meanwhile, a brake disc 90 is disposed to that end of the shaft of the preheating roll 70 which extends outward from the split frame 50 locating on the operational side to be rotatable integrally with the roll 70, and the disc 90 is interposed between a pair of jaws 87*a* of the brake caliper 87. The solenoid switch valve 89 is designed to supply air to the brake caliper 87 whenever a deceleration signal is input to a control unit (not shown) to allow the pair of jaws 87*a* to hold the brake disc 90 tightly therebetween. It should be noted here that the force of the brake caliper 87 to hold the brake disc 90 is so small that there may occur no defective bonding between the corrugating medium 20 and the liner 66 by braking the preheating roll 70 and the endless belt 74.

In the control unit, deceleration of the upper and lower fluted rolls 16,18 is designed to start with a predetermined time lag (about 1 second) after the deceleration signal is input. A timer, for example, is used as the delaying means. Namely, a braking force is applied to the endless belt 74 by the brake caliper 87 and brake disc 90 to decelerate the endless belt 74 to a level such that the belt 74 can follow the decelerated speed of the lower fluted roll 18, and then the upper and lower fluted rolls 16,18 are designed to be decelerated in this state. Incidentally, since the generation in the difference between the speed of the lower fluted roll 18 and that of the endless belt 74 under deceleration of the upper and lower fluted rolls 16,18 varies depending on the level of the normal state running speed, the time lag is suitably adjusted depending on the operation speed.

(Working of the embodiment)

Next, working of the belt speed controller in a single facer according to the embodiment described above will be described. During operation of the single facet according to the embodiment, the tension roll 72 is urged by the hydraulic cylinders 76 to apply a predetermined tension to the endless belt 74 extended over the three rolls 68,70,72 of the primary application mechanism 54. Accordingly, the portion of the endless belt 74 running between the drive roll 68 and the preheating roll 70 is brought closer to the lower fluted roll 18 to bring the corrugating medium 20 and liner 66 fed along the circumference of the lower fluted roll 18 into press contact with the surface of the roll 18. Meanwhile, compressed air is fed to the tubes 85 in the secondary application mechanism 81, so that the endless belt 74 is brought into press contact with the corrugating medium 20 and liner 66 over the entire width thereof by the pressing member 83. Thus, the corrugating medium 20 and liner 66 are nipped over a predetermined width between the lower fluted roll 18 and the endless belt 74 to be bonded together securely at the glued portions.

When a deceleration switch (not shown) of the control unit is operated so as to carry out splicing of the corrugating medium 20 and the liner 66 in accordance with an order change, a deceleration signal is output, and the solenoid switch valve 89 is first let open to supply air to the brake caliper 87 based on the deceleration signal. The brake disc 90 attached to the preheating roll 70 is then held tightly by the caliper 87 to apply a predetermined braking force to the preheating roll 70. Thus, the braking force is further applied via the preheating roll 70 to the endless belt 74 running over the bonding zone to decelerate the endless belt 74. With a predetermined time lag (about 1 second) after the deceleration signal is input, deceleration of the upper and lower fluted rolls 16,18 is started. The drive roll 68 is also decelerated following the upper and lower fluted rolls 16,18.

Namely, at the time when deceleration of the upper and lower fluted rolls 16,18 is to be started, the endless belt 74 is already braked to a predetermined speed level via the preheating roll 70, so that the belt 74 can be decelerated following the lower fluted roll 18. Further, since the endless belt 74 is braked on the upstream side of the bonding zone, the belt 74 is constantly stretched tight over the bonding zone to be slackless when the drive roll 68 is decelerated. As described above, since the endless belt 74 runs slackless over the bonding zone at the same speed as the lower fluted roll 18 rotates in decelerating the upper and lower fluted rolls 16,18, the corrugating medium 20 can securely be bonded with the liner 66.

It should be noted here that the preheating roll 70 is designed to be braked in the primary application mechanism 54 consisting of a drive roll 68, a preheating roll 70, a tension roll 72 and an endless belt 74 extended over these three rolls 68,70,72 in this embodiment, but the present invention is not limited to such embodiment. For example, the endless belt 74 may be extended over two rolls, i.e. the drive roll 68 and the tension roll 72, and the tension roll 72 disposed on the upstream side of the bonding zone may be braked. The belt speed controller of the embodiment above-described can also be employed in a single facer having a primary application mechanism 54 in which the endless belt 74 is extended over the three rolls 68,70,72 or two rolls 68,72. Further, the type of braking means is not limited to the disc brake as used in the embodiment, but various kinds of other means including a drum brake in which a braker is brought into press contact with the inner or outer surface of a drum disposed on the shaft can be employed. Meanwhile, as the drive source of the braker, a suitable means selected from a fluid pressure such as air and hydraulic pressure, and electromagnetic means can be used. Further, while the endless belt 74 is braked immediately before the upper and lower fluted rolls 16,18 are decelerated in the embodiment described above, the same effect can be exhibited even when the endless belt 74 is braked at the same time when the fluted rolls 16,18 are decelerated.

Figure 7:
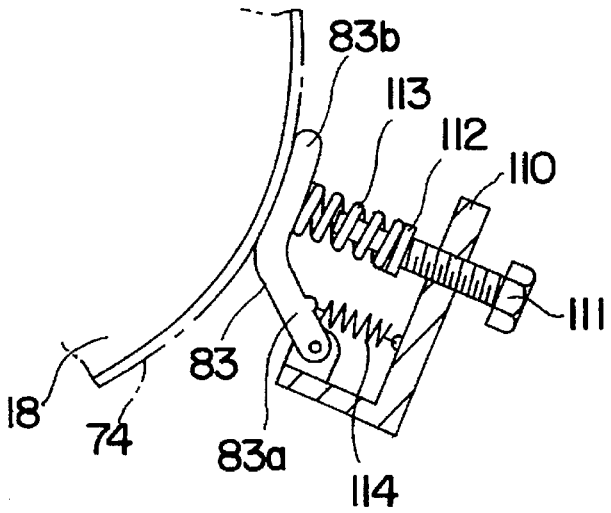
FIG. 7 shows schematically the constitution of another example of the major section of the secondary application mechanism according to the embodiment of the invention.

As the secondary application mechanism 81, another example shown in FIG. 7 can be employed. This application mechanism 81 consists of a bracket 110 fixed to the main body 14 and a V-shaped pressing member 83 with one arm 83*a* thereof being pivoted onto the bracket 110. The other arm 83*b* of the pressing member 83 is arcuated on the surface facing the lower fluted roll 18 after the circumferential curve of the roll 18. An adjust bolt 111 is screwed into the bracket 110, and a regulating section 112 is provided at a predetermined position of this bolt 111 extending from the bracket 110 toward the lower fluted roll 18, with a compression spring 113 being resiliently interposed between this regulating section 112 and the arm 83*b*. Namely, the arm 83*b* of the pressing member 83 is designed to be brought into press contact with the lower fluted roll 18 via the endless belt 74 in the primary application mechanism 54, liner 66 and corrugating medium 20 under the resilience of the compression spring 113. The pressure to be applied to the endless belt 74 is adjusted by moving the adjust bolt 111 with respect to the bracket 110. Incidentally, an extension spring 114 is interposed between the bracket 110 and the arm 83*a* of the pressing member 83, so that the arm 83*b* may be spaced from the endless belt 74 under the resilience of the extension spring 114, when the compression spring 113 is loosened.

Figure 8:
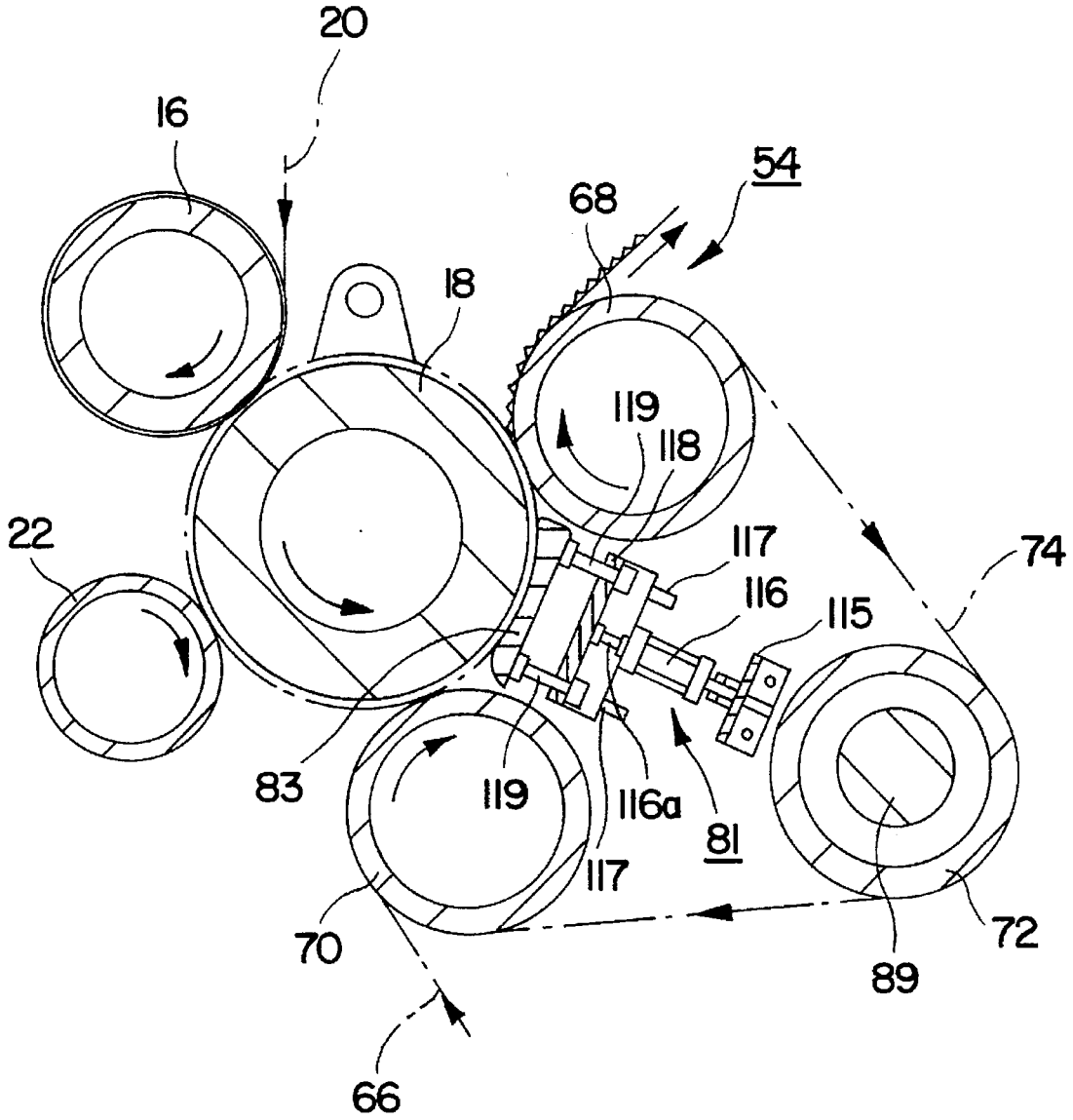
FIG. 8 shows schematically the constitution of still another example of the major section of the secondary application mechanism according to the embodiment of the invention.

FIG. 8 shows another example of the secondary application mechanism 81, which has a bracket 115 fixed to the main body 14, an air cylinder 116 pivotably supported at the bottom on the bracket 115, and a supporting plate 118 which is slidably disposed on the main body 14 via a pair of guide rails 117 is connected to the piston rod 116*a* of the air cylinder 116. A pressing member 83 is disposed to the supporting plate 118 via a plurality of rods 119 fixed thereon. Incidentally, the air cylinder 116 is operated under control to move the pressing member 83 between an urging position where the pressing member 83 is brought closer to the lower fluted roll 18 via the supporting plate 118 and a retracted position where the pressing member 83 is spaced from the lower fluted roll 18. Namely, when the supporting plate 118 and the pressing member 83 are shifted to the urging position by operating the air cylinder 116 so as to extend the piston rod 116*a* thereof, the pressing member 83 is brought into press contact with the lower fluted roll 18 via the endless belt 74, liner 66 and corrugating medium 20 under the operation of the cylinder 116.

As the air cylinder 116, a single action cylinder is suitably employed, and the pressing member 83 is brought closer to the lower fluted roll 18 by supplying air to the cylinder; whereas the pressing member 83 is retracted from the lower fluted roll 18 with the aid of a spring disposed in the secondary application mechanism 81 by exhausting air from the cylinder. Alternatively, a double action cylinder may be employed in place of the single action cylinder. Further, the air cylinder 116 may not necessarily be used, and an oil pressure cylinder or a water pressure cylinder may be employed.

Referring to the secondary application mechanism 81 shown in FIG. 7 or 8, the mechanism 81 may be of a single block disposed along the axis of the lower fluted roll 18, or may consist of a plurality of blocks arranged in the axial direction of the lower fluted roll 18 or arranged in rows in the circumferential direction of the lower fluted roll 18. It should be noted here that when the secondary application mechanism 81 consists of a plurality of blocks, the compression spring 112 and cylinder 116 are disposed on each block.

It should be apparent to those skilled in the art that the present invention may be embodied in many other specific forms without departing from the spirit or scope of the invention. Therefore, the present embodiments and examples are to be considered as illustrative and not restrictive, and the invention is not to be limited to the details given herein, but may be modified within the scope of the appended claims.

What is claimed is:

1. A belt speed controller, in a single facer consisting of an upper fluted roll having flutes formed on the circumference thereof; a lower fluted roll, also having on the circumference thereof flutes which are engaged with those of said upper fluted rolls to form a predetermined corrugation on a corrugating medium passed between said upper fluted roll and said lower fluted roll; a gluing mechanism for gluing the crests of said predetermined corrugation in said corrugating medium; and an application mechanism which is disposed adjacent to said lower fluted roll and equipped with an endless belt extended over a plurality of rolls so as to be able to run freely thereby; in which a liner is pressed against the glued crests of said predetermined corrugation of said corrugating medium fed along the circumference of said lower fluted roll to be pasted with said corrugating medium and form a single-faced corrugated board;

characterized in that said speed controller consists of a braking means for braking one of said plurality of rolls over which said endless belt is extended which is located on an upstream side, with respect to the endless belt running direction, of a press contact zone where said endless belt is brought into press contact with said liner, and a control means which actuates said braking means to brake said endless belt via said one of said plurality of rolls.

2. The belt speed controller in a single facet according to claim 1, wherein said one of said plurality of rolls to be braked is disposed on an upstream side of the lower fluted roll with respect to a direction of feeding said corrugating medium, while a drive roll of said plurality of rolls is rotatably driven by a drive source of said lower fluted roll is disposed on a downstream side of said one of said plurality of rolls, and said endless belt is brought into press contact with said lower fluted roll via said corrugating medium fed along the circumference of said lower fluted roll and said liner fed via said endless belt along the circumference of said one of said plurality of rolls.

3. The belt speed controller in a single facer according to claim 1, wherein said braking means further comprises an actuating means for actuating said braking means immediately before deceleration of said upper and lower fluted rolls to apply a braking force to said endless belt beforehand.

* * * * *